United States Patent [19]

Richey

[11] 4,049,066

[45] Sept. 20, 1977

[54] APPARATUS FOR REDUCING ANNULAR BACK PRESSURE NEAR THE DRILL BIT

[76] Inventor: Vernon T. Richey, 1111 Blalock, Apt. 160, Houston, Tex. 77055

[21] Appl. No.: 677,926

[22] Filed: Apr. 19, 1976

[51] Int. Cl.[2] ..... E21B 17/00

[52] U.S. Cl. ..... 175/323; 175/67; 175/107; 175/324; 417/336

[58] Field of Search ..... 175/217, 213, 323, 324, 175/102, 93, 94, 106, 107, 67, 48; 417/334, 336

[56] References Cited

U.S. PATENT DOCUMENTS

| | | | |
|---|---|---|---|
| 1,880,214 | 10/1932 | Simmons | 175/102 |
| 2,635,852 | 4/1953 | Snyder | 175/102 X |
| 2,794,617 | 6/1957 | Yancey | 175/323 |
| 2,849,214 | 8/1958 | Hall | 175/324 |
| 2,976,027 | 3/1961 | Alliman | 175/106 X |
| 3,656,565 | 4/1972 | Fox | 175/102 X |
| 3,971,450 | 7/1976 | Fox | 175/107 |

*Primary Examiner*—Ernest R. Purser
*Assistant Examiner*—Richard E. Favreau
*Attorney, Agent, or Firm*—Guy E. Matthews

[57] ABSTRACT

An apparatus adapted to be connected in a drill string is disclosed. It utilizes an axially located turbine which is driven by the mud flow through the drill string. The turbine is supported by a shaft and connected to an appropriate gear train. The gear train rotates an outer sleeve which has multiple turns of an external screw thereon. The screw or helix extends toward the wall of the drill bore. The helix lifts the column of mud in the annular space above the drill bit away from the drill bit thereby reducing the back pressure just above the drill bit. This improves the jetting action of the mud pumped through the drill bit and provides for a more rapid excavation of the immediate vicinity, thereby increasing the rate of penetration of the drill bit.

10 Claims, 4 Drawing Figures

APPARATUS FOR REDUCING ANNULAR BACK PRESSURE NEAR THE DRILL BIT

BACKGROUND OF THE INVENTION

In the drilling of an oil well, mud is normally pumped through the drill string, through a specified number of drill collars and through the drill bit to lubricate the hole. As the drill bit penetrates the earth, cuttings from the face of the hole are washed away from the drill bit by mud flowing upwardly in the annulus. As the well deepens, the back pressure of the mud in the annular space increases dependent on the height of the column and the back pressure maintained in the annular system including the choke which delivers the mud to the mud pits. As this back pressure increases, it requires a higher pressure in the drill string to overcome the hydrostatic head of the column of mud standing in the annulus. The high back pressure in the annulus works against the jetting action of the mud flow. This has undesirable results which are a reduction in the rapidity of the washing of rock particles away from the near vicinity of the bit. In addition, it reduces the jetting action. By jetting, reference is made to the tendency of a mud jet flowing from the drill bit to actually wash or erode some of the rock before it has been cut by the teeth on the drill bit. In other words, a portion of the drilling is achieved by the jetting action without regard to the cutting action of the bit itself. Both ramifications are undesirable.

The apparatus of the present invention overcomes these drawbacks. It is necessary of course for the mud to return in the annulus. The mud which flows in the annulus ordinarily may be viewed, statically speaking, as standing on the bottom of the hole itself and thus it interferes with the jetting action and the rapid removal of chips. This is not the case with the present disclosure. Rather, a set of protruding helical turns on a screw mounted on the drill string actually supports the column of mud. More precisely, the mud is picked up by the bottom most flite of the helical thread on the exterior and is pulled rapidly away from the bottom of the well to thereby reduce the pressure just above the drill bit. The helical screw thus provides a type of pumping action and thereby actually enables the column of mud in the annulus to stand on it rather than on the bottom of the hole. It provides an upward pumping action which rapidly evacuates the area near the drill bit, reducing hydrostatic pressure there and initiating the mud in the upward flow. In other words, the apparatus disclosed herein provides a positive pumping action to the mud rather than merely rely on the U-tube effect.

The present disclosure thus is an apparatus which utilizes the energy in the flowing mud stream within the drill string and converts it into rotary motion of a lifting screw on the exterior and immediately above the drill bit to pressurize the mud in the annulus and clear the vicinity of the drill bit.

SUMMARY OF THE INVENTION

This apparatus is a device to be placed in a drill string immediately above a drill bit and below the drill collars. It incorporates an elongate tubular member threaded into the drill string and threaded into the drill bit. On the interior, a lengthwise shaft mounts several sets of blades which rotate in response to the mud flow around the shaft. The shaft is connected through a gear train to the exterior. On the exterior, a rotatable sleeve is mounted on appropriate bearing assemblies. The external sleeve rotates at a multiturn helical screw. The screw flites extend toward the well bore, and lift the mud in the annulus and pumps it upwardly.

DESCRIPTION OF THE PREFERRED EMBODIMENT

Figure 1:
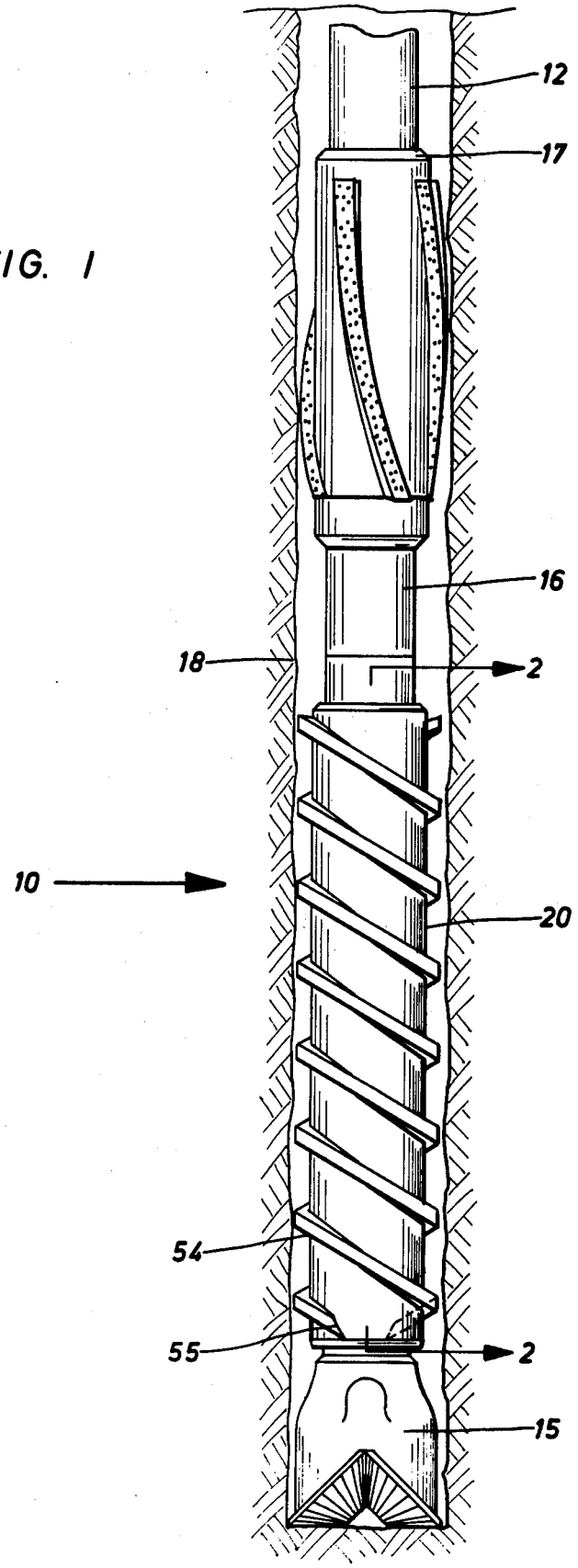
FIG. 1 shows the device of the present disclosure mounted in a drill string above a drill bit for pumping mud upwardly through the annulus around the drill string.

Attention is first directed to FIG. 1 of the drawings where the annular mud pump 10 of the present invention is shown in a drill string 12. A drill bit 15 is incorporated at the lower end and is rotated by the drill string. The mud pump 10 is threaded to the drill bit 15 and is also connected to a drill collar 16 thereabove. The device includes a typical pin and box connection. The drill collar 16 supports a stabilizer 17. The drill string of course is rotated in the clockwise direction as is customary in the drilling industry to advance the drill bit 15 in the well bore 18. As hole is made, the drill string 12 is lengthened, thereby increasing the hydrostatic pressure of the mud accumulated in the annular space on the exterior of the drill string 12. Mud flows axially down through the drill string 12 and is returned to the surface through the annular space where the mud is treated.

The annular mud pump 10 is better shown in sectional view. It incorporates a central tubular member 19 which is equipped with the appropriate pin and box so that it can be threaded into the drill string. The tubular member 19 extends the full length of the tool. It rotates with the drill string. It will be referred to as the stationary tubular member herein inasmuch as it is the nonmoving part of the mud pump 10. In actual use, it may rotate rapidly or slowly but it is completely dependent for its rotation on the drill string proper. It is to be contrasted with an external sleeve 20 which rotates in the opposite direction. In other words, it is driven to rotate in the counterclockwise direction. The tubular member 20 is concentric with the tubular member 19 and is mounted on the exterior. It is supported by appropriate bearing assemblies as will be described.

Figure 2:
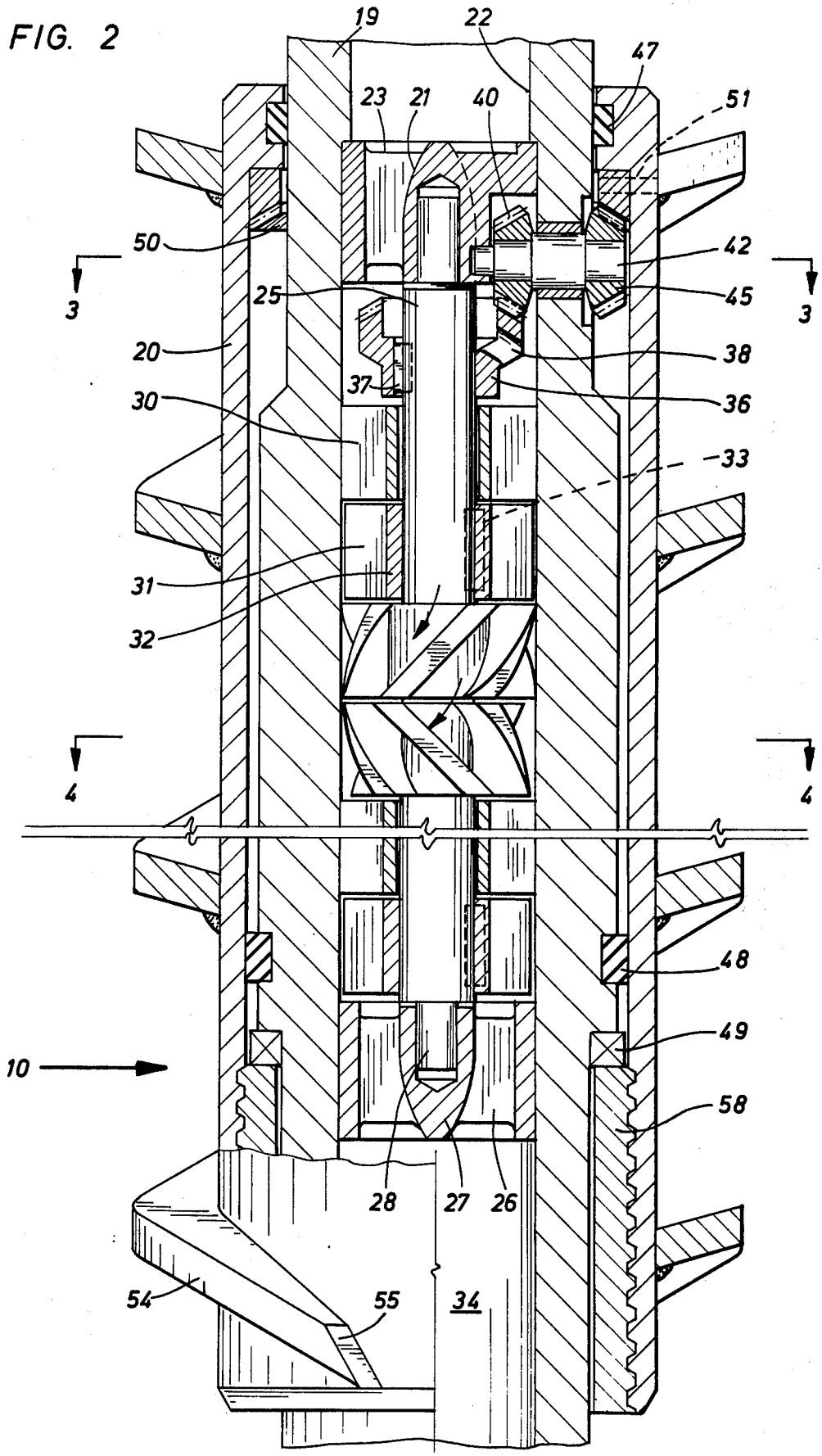
FIG. 2 is a sectional view along the line 2—2 of FIG. 1 showing in enlarged detail an axial shaft mounting a set of turbine blades which are rotated by mud flow therein and which rotates an external sleeve having a helical screw thereon.
Figure 3:
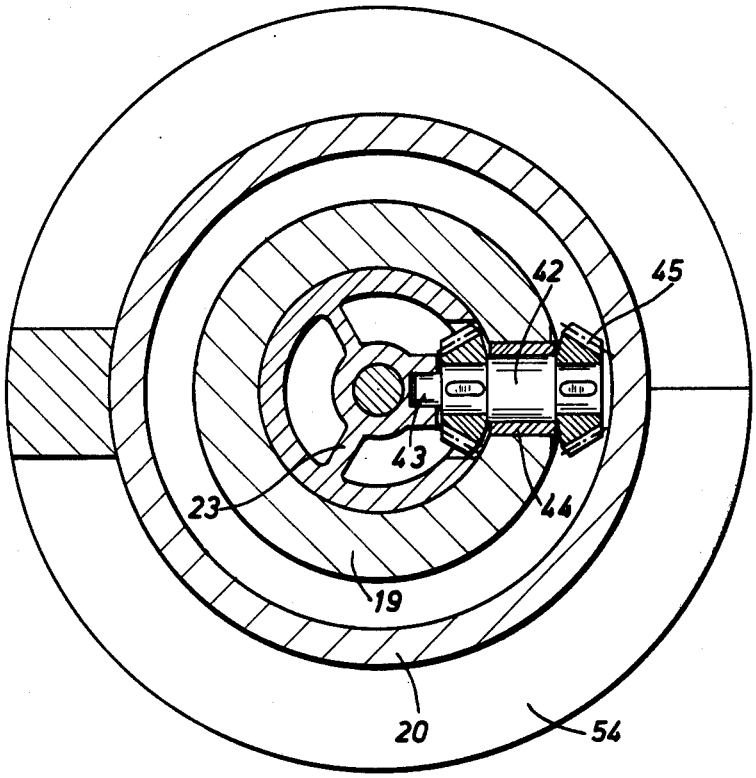
FIG. 3 is a sectional view along the line 3—3 of FIG. 2 showing internal details of construction of the central shaft, a lateral shaft, and gear train.
Figure 4:
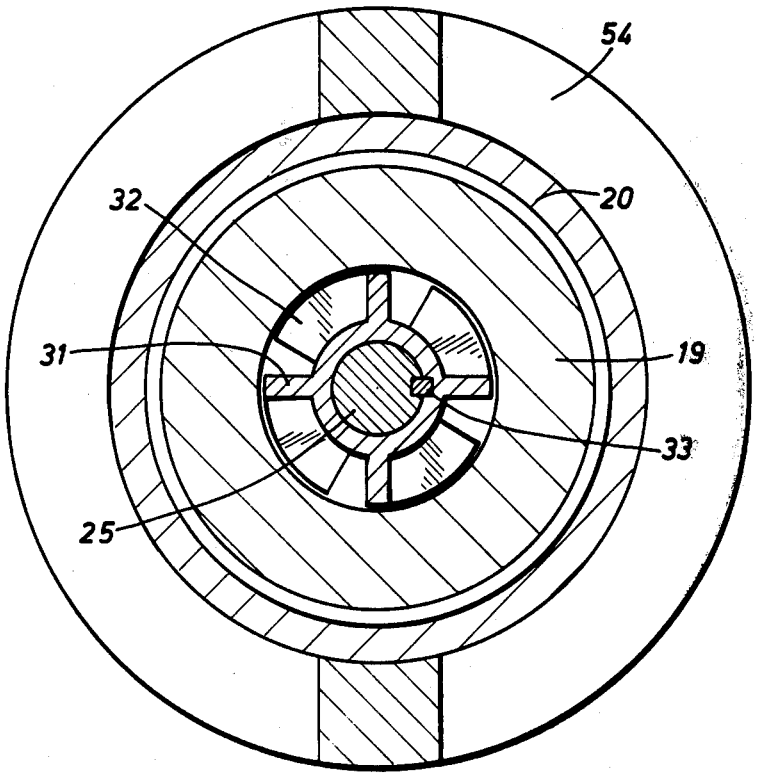
FIG. 4 is a sectional view along the line 4—4 of FIG. 2 showing details of construction of the turban blades mounted on the central shaft.

In FIG. 2, the numeral 21 identifies a streamlined tubular housing. The housing is fixed centrally of an axial passage 22. The passage 22 delivers mud flow through the drill string past the streamlined tubular housing 21. The streamlined or bullet shaped housing 21 is supported in the center of the axial passage by two or three arms 23 of a spider mounting. The spider is better shown in FIG. 3 of the drawings. There it will be observed that a substantial axial passage is provided past the bullet shaped or streamlined housing 21. The housing of course is fixed and stationary. It is counterbored from the bottom to support a shaft 25 which is axially located in the tubular sleeve 19. The shaft is fairly long and extends below the upper end to a similar spider 26 at the lower end of the tool. The spider 26 supports a central, fixed, counterbored housing 27. It is counterbored to receive a stub 28. The stub shaft 28 is concentric with and appended to the lower end of the main shaft 25. The shaft 25 is thus supported in a similar manner at both ends.

The numeral 30 identifies a first set of turbine blades. The blades 30 are joined to the inside wall of the tubular member 19 and extend towards the shaft 25. The blades 30 do not touch the shaft and stop just short of the shaft. The numeral 31 identifies a second set of turbine blades. The turbine blades 31 are joined to a circular collar 32 which encircles the shaft 25. The collar is fixed to the shaft by a key 33 inserted into a longitudinal slot in the shaft to lock the collar in position. The blades 31 extend from the collar outwardly almost to the inside wall of the tubular member 19.

The blades 30 have a specified pitch angle while the blades 31 have a pitch angle approximately the same but in the opposite hand. This is more clearly shown by the two sets of blades illustrated in the center portion of FIG. 2. The blades 30 are fixed in position. They impart a flow direction to the mud flowing through the apparatus, and the next set of blades (keyed to the shaft) are positioned at the opposite angle. They are rotated by the mud flow. The mud flow along the length of the tubular member 19 thus encounters alternating sets of blades. The first set encountered is a fixed set 30 imparting a twist to the mud flow, and the second set of blades mounted on the shaft 25 are set at to an opposite angle and they are rotated by the mud flow impinging on them. The use of alternating sets enables the mud flow to be redirected by the fixed blades to extract additional work from the mud flow. The mud thus flows past the length of the shaft 25 and imparts rotation to the shaft. The shaft is supported between the housings 21 and 27, the support being provided by the appended stub shafts at each end which are received in the countersunk openings in the housings. Mud flow is thus introduced at the upper end of the tubular member 19 and is delivered through the lower axial passage 34 at the lower end for the drill bit connected therebelow.

The shaft 25 is thus rotated by the mud flow through the annular mud pump 10. The shaft carries at its upper end a beveled gear 36. The gear 36 incorporates a tubular sleeve which fits snuggly about the shaft. A key 37 secures the sleeve to the shaft, sized keyways being formed on the interior of the tubular sleeve and on the exterior of the shaft 25. A set of teeth are formed at a beveled angle on the gear. Mud flow passages 38 are drilled at spaced locations to enable the mud to flow through the gear. The gear 36 meshes with a gear 40 which is equipped with beveled teeth. The gear 40 is supported on a lateral shaft 42. The shaft 42 is better shown in FIG. 3 of the drawings. The shaft 42 at one end is received in a drilled opening 43 in the streamlined housing 21. It is supported at its central portion in a sleeve or bushing 44. The sleeve or bushing 44 is received in the sidewall of the tubular member 19 and enables the shaft 42 to extend to the exterior. On the exterior, the shaft 42 supports a gear 45. The gear 45 is provided with beveled teeth also.

Returning to FIG. 2 of the drawings, the external sleeve 20 is held concentric about the tubular member 19 by a mud seal 47 at the upper end and a similar mud seal 48 at the lower end. The numeral 49 identifies a bearing assembly. An annular cavity between the tubular members 19 and 20 is thus defined for the gear 45 which is located in that cavity. The gear 45 is provided with beveled teeth and meshes with a beveled gear 50 in the upper end of the annular cavity. The gear 50 is a ring gear which is fixed by an insert pin 51. It is pinned in the upper end of the cavity and is held in position. The ring gear 50 is rotated by the beveled gear 45.

It will be observed that the tubular member 19 is rotated only when the drill string is rotated. It rotates clockwise at the drilling rig. The mud flow through the tubular member 19 rotates the shaft clockwise. The shaft will rotate at a greater speed than the tubular member 19. The shaft 42 rotates in a clockwise directon as viewed from the outer end of the shaft. The ring gear 50 and the outer tubular member 19 are rotated counterclockwise as viewed from above. The sleeve 20 thus rotates in the opposite direction as the tubular member 19.

Referring momentarily to FIG. 1 of the drawings, the external sleeve 20 incorporates two flites of a helical screw 54. Some increase in efficiency is obtained by the use of two flites. With the directon of rotation as indicated by the arrow in FIG. 1, it will be observed that the screw rotates to lift mud in the annular cavity around the drill bit upwardly in the well bore 18. The screw 54 thus serves as a pump. At the lower end, the leading edge 55 of the screw 54 has an angularly cut face to scoop up mud. This also reduces the tendency of chips in the mud flow to abrade the screw. The lower end takes a bite into the column of mud in the near vicinity of the drill bit 15 and lifts the mud into the annular space between flites of the screw. The mud is lifted upwardly and as the sleeve 20 rotates, it is forced along the screw to the top end of the sleeve 20. There is a tendency for mud to spill off of the screw and fall back down into the annular space. However, this is substantially reduced by the formation of mud cake on the wall of the well bore 18. While there is some clearance, the screw 54 limits the thickness of the mud cake and hence the clearance on the exterior of the mud pump 10 is substantially reduced. To this end, it is desirable to limit the diameter of the screw 54 to the diameter of the hole drilled by the drill bit 15. The preferable diameter of the screw 54 is a fraction of an inch smaller.

Returning now to FIG. 2 of the drawings, it will be observed at the lower end of the sleeve 20 that it is internally threaded and that a lock nut 58 is threaded into it to abut the bearing assembly 49 to lock the bearing assembly into position and to limit lengthwise movement of the tubular sleeve 20. The lock nut 58 is thus telescoped on the inside of the tubular sleeve 20. It fits around the tubular member 19 with a modest amount of clearance. The lock nut 58 can be unthreaded in the event the tubular sleeve 20 has to be removed for servicing.

In operation, the annular mud pump 10 is installed in the drill string as illustrated in FIG. 1. When the drill string is rotated in the customary clockwise direction, the sleeves 19 and 20 rotate together. After mud flow is initiated, the sleeve 20 rotates in the opposite direction. The rate of flow of the mud through the drill string and the fixed ratio established by the gear train extending from the shaft 25 to the sleeve 20 control the speed of the sleeve. In any case, the sleeve 20 is rotated and the screw 54 on the exterior surface lifts mud away from the vicinity of the drill bit. The screw 54 thus lifts the mud away from the drill bit and forces it upwardly into the annular space, thereby causing the hydrostatic column of flowing mud in the annulus to rest on the screw. This reduces back pressure at the vicinity of the drill bit. There is some loss of pressure at the drill bit as a result of the power removed from the mud stream by the turbine blades shown in FIG. 2. This is compensated for by an even larger drop in hydrostatic back pressure in the annular space. This then clears the vicinity of the drill bit for jetting action and removal of the cuttings by the mud flow from the drill bit.

The foregoing is directed to the preferred embodiment but the scope thereof is set forth by the claims which follow.

I claim:

1. An annular mud pump for use in a drill string in drilling a well bore which is adapted to be located above the drill bit in the drill string and which comprises:

an elongate tubular member adapted to be connected in a drill string at the upper end and further adapted to be located above a drill bit attached at the lower end of the drill string;

a second tubular member positioned concentrically about the first tubular member;

motor means in said first tubular member, said motor means being positioned and exposed to the flow of mud therethrough flowing through the drill string and said tubular member, said motor means having a set of blades which are rotated by the mud flow and which rotates an output shaft;

gear means connected to the output shaft of said motor means;

a gear connected to said second tubular member and comprising a portion of said gear means said gear being fixed to said outer tubular member for rotating the second tubular member in response to operation of said motor means; and a multiflite screw on the exterior of said second tubular member which is rotated in the annulus of the well bore in a direction to lift drilling mud by the flites of the said screw.

2. The apparatus of claim 1 including seal means isolating an annular cavity between said first and second tubular members, and mud seal means in said cavity for excluding mud therefrom.

3. The apparatus of claim 1 wherein said motor means includes a shaft axially positioned of said first tubular member, said shaft mounting said blades in an elongate passage in said first tubular member, said blades rotating said shaft which is mounted by first and second spaced apart shaft mounting means in said first tubular member.

4. The apparatus of claim 3 wherein said first and second shaft mounting means each comprises a centered hub supported by a transversely positioned arm connected to said first tubular member.

5. The apparatus of claim 4 wherein said centered hub fits around the end of said shaft, and said shaft includes a stub end portion received in said hub.

6. The apparatus of claim 1 including first and second sets of blades, said first set fixed to said first tubular member and said second set rotatably mounted on a shaft through said first tubular member, said first and second sets of blades cooperatively directing mud flow through past said second set of blades to rotate said second set of blades and thereby rotate said shaft.

7. The apparatus of claim 6 wherein said first set of blades imparts an angled direction of flow to the mud flowing therepast and said second set of blades is set to intersect that flow.

8. The apparatus of claim 6 including alternating fixed and rotatable blades along the length of said first tubular member.

9. The apparatus of claim 8 wherein said blades are arranged in an axial passage through said first tubular member, and are alternated between fixed and movable blades, all of said movable blades joined to said shaft.

10. The apparatus of claim 9 wherein said alternated blades are arranged in set alternately joined to said shaft and to said first tubular member.

* * * * *